US007290560B2

(12) United States Patent
Orr et al.

(10) Patent No.: US 7,290,560 B2
(45) Date of Patent: Nov. 6, 2007

(54) VALVE COVER LOCKING SYSTEM

(75) Inventors: Alan Orr, Tulsa, OK (US); Eric Thomas Greager, Owasso, OK (US); Ernest J. Jensen, Tulsa, OK (US)

(73) Assignee: Helmerich & Payne, Inc., Tulsa, OK (US)

( * ) Notice: Subject to any disclaimer, the term of this patent is extended or adjusted under 35 U.S.C. 154(b) by 672 days.

(21) Appl. No.: 10/822,906

(22) Filed: Apr. 13, 2004

(65) Prior Publication Data

US 2005/0226754 A1 Oct. 13, 2005

(51) Int. Cl.
*F16K 25/00* (2006.01)

(52) U.S. Cl. ..... 137/454.6; 137/454.4; 137/454.2

(58) Field of Classification Search ..... 137/377, 137/382, 454.6, 454.4, 454.2; 251/366; 417/454
See application file for complete search history.

(56) References Cited

U.S. PATENT DOCUMENTS 3,235,272 A * 2/1966 Smith ..... 277/399
4,039,003 A * 8/1977 Cheek ..... 137/516.29
4,187,872 A * 2/1980 Freeman et al. ..... 137/454.6
4,508,133 A * 4/1985 Hamid ..... 137/68.22
4,601,304 A * 7/1986 Schobl ..... 137/315.27
4,661,050 A * 4/1987 Deminski ..... 417/454
4,718,444 A * 1/1988 Boelte ..... 137/15.22
5,362,215 A * 11/1994 King ..... 417/455
5,605,449 A * 2/1997 Reed ..... 417/454

* cited by examiner

*Primary Examiner*—John Rivell
*Assistant Examiner*—Cloud Lee
(74) *Attorney, Agent, or Firm*—Head, Johnson & Kachigian

(57) ABSTRACT

An apparatus and method to assemble and disassemble a valve cover locking screw assembly for a reciprocating pump module block. The module block has a bore, a removable valve cover closing the bore, and a valve cover locking ring securable to the block and surrounding the bore with internal threads. A valve cover locking screw has cylindrical walls with external threads, a closed top, and an open bottom. A plurality of threaded bolts engage a plurality of threaded openings through the cylindrical walls of the locking screw so that the bolts force the valve cover against the module block thereby creating a fluid tight seal.

13 Claims, 3 Drawing Sheets

VALVE COVER LOCKING SYSTEM

BACKGROUND OF THE INVENTION

1. Field of the Invention

The present invention is directed to a valve cover locking screw assembly for a reciprocating pump.

2. Background of Invention

Drilling fluid (sometimes referred to as "drilling mud"), which is often times a petroleum or water based fluid product, is used in drilling and workover rig applications.

Drilling fluid serves a number of important functions in the drilling operations. The drilling fluid serves to assist in cleaning the bottom of the wellbore hole and transports drill cuttings to the surface where they are removed. The drilling fluid also cools the drill bit and lubricates the drill stem. Additionally, the drilling fluid assists in supporting the walls of the wellbore and discourages entry of fluids into the well. Finally, the drilling fluid can reveal the presence of oil, gas or water that may enter the fluid from a formation being drilled and may reveal information about the formation through drill cuttings.

The drilling fluid at a drilling or workover rig site is utilized in a circulating system so that the drilling fluid may be reused. In other words, the drilling fluid may be moved from the surface thousands of feet downhole and then returned to the surface. The time required for the drilling fluid to travel from pump suction to pump suction is known as a complete cycle.

A mud circulation system can include a mud tank. The mud tank can supply mud to a pump or pumps to begin circulation, receive the drilling fluid circulated out of the well and store reserve mud.

A reciprocating pump or pumps are utilized to move the drilling fluid from the surface through a series of pipes including a standpipe and rotary hose and then downhole to the subterranean drilling location. The drilling fluid will often be moved thousands of feet down drill pipe and out small nozzles in a drill bit. Thereafter, the pumps circulate the drilling fluid back to the surface through an annulus where the drilling mud is passed through various conditioning equipment. The equipment may include a vibrating screen assembly and separator mechanisms to remove entrained solids such as rocks or drilling cuttings. Other equipment may include degassers and mud agitators.

A reciprocating pump is a positive displacement pump. A plunger or piston reciprocates (moves back and forth) inside a cylinder. The reciprocating movement of the piston displaces or moves the drilling fluid. Drilling rigs have utilized both single-acting triplex pumps and double-acting duplex pumps.

Mud pumps are known to operate at up to 2200 horsepower. These mud pumps can include components which are required to be frequently changed and also inspected from time to time. For example, valves, seats, and springs are expendable items that may be inspected and replaced.

In one known mud pump arrangement, a module block contains a number of bores. A removable valve cover closes the bores and a valve cover locking ring surrounds each bore. A cylindrical locking screw having an open bottom and a closed top includes external threads which mate with internal threads on the locking ring. A number of openings perpendicular to the axis of the cylindrical walls is provided through the walls of the cylindrical screw so that a pole or other tool is placed through an opening or openings to gain leverage in order to tighten or untighten the screw.

SUMMARY OF THE INVENTION

The present invention is directed to a valve cover locking screw assembly for a reciprocating pump module block. The module block has at least one bore, a removable valve cover which covers and closes the bore, and a valve cover locking ring with internal threads which surround the bore.

The module block is in fluid communication with a suction end and a discharge end of the pump. The module block has a number of bores with each bore providing access to a valve or valves and associated components operating within the module block. A locking ring surrounds the bore and has a cylindrical opening therethrough. Each locking ring is cylindrical with internal threads. The assembly includes a valve cover having a diameter slightly less than the inside diameter of the locking ring. A circular gasket resides between the valve cover and the module block. A plurality of threaded studs and nuts secure the locking ring to the module block.

The assembly also includes a valve cover locking screw having cylindrical walls with external threads on the walls. The external threads of the locking screw mate with internal threads on the locking ring. The locking screw also includes a closed top and an opened bottom.

A plurality of threaded bolts engage a plurality of threaded openings which pass through the cylindrical walls of the locking screw so that the bolts force the valve cover against the module block to create and enhance a fluid tight seal. Each threaded opening is parallel to an axis of the cylindrical walls of the locking screw.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is to be understood that the invention is not limited to the embodiments set forth herein for purposes of exemplification.

Figure 1:
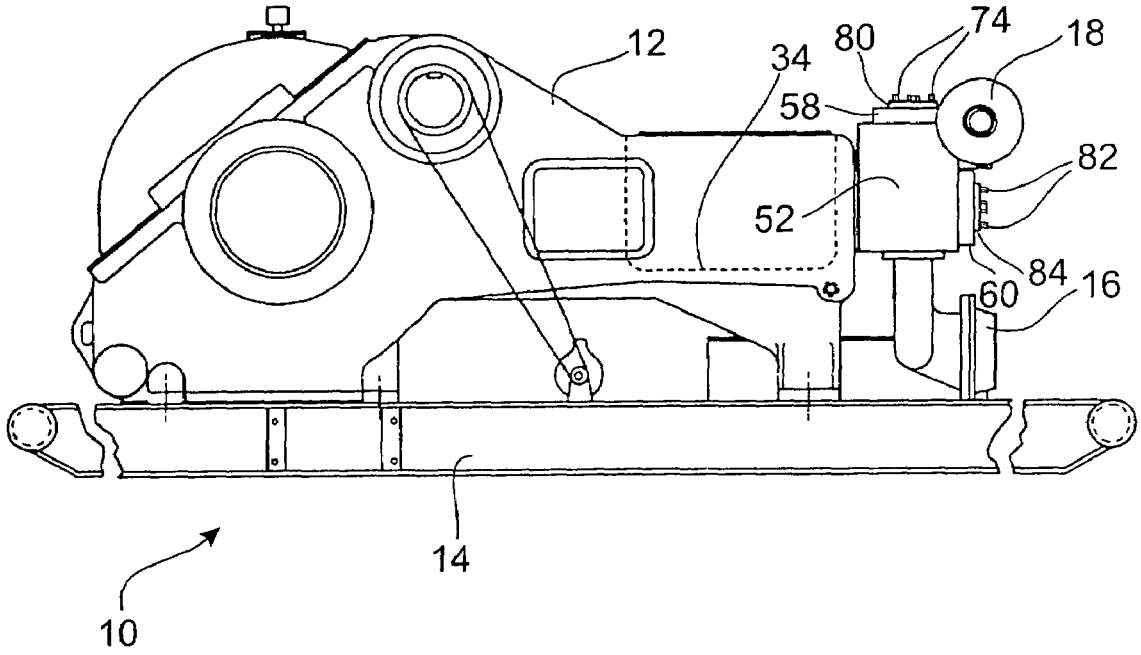
FIG. 1 illustrates a side view of a known reciprocating pump for a drilling rig or workover rig which incorporates one example of a valve cover locking system which is the subject of the present invention.
Figure 2:
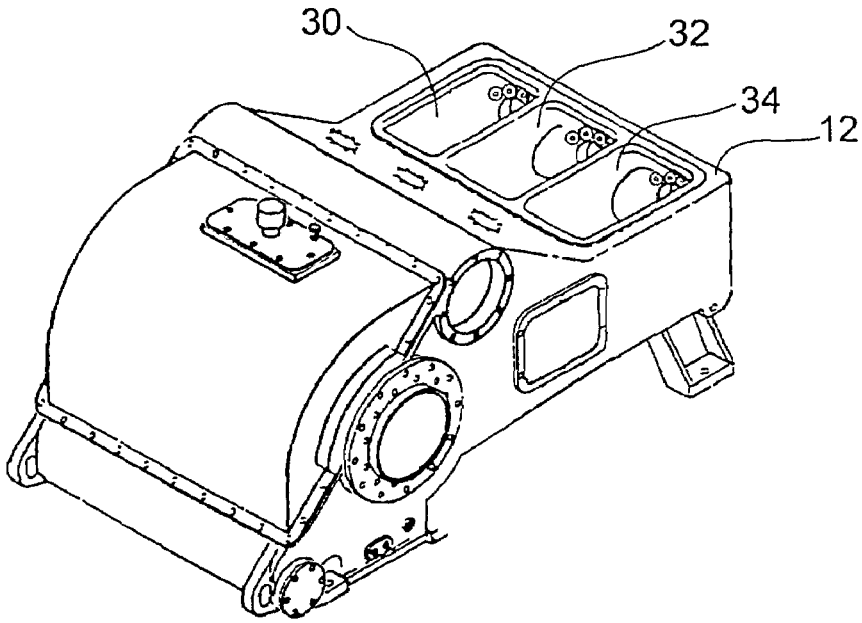
FIG. 2 is a perspective view of a known frame for a pump for the reciprocating pump shown in FIG. 1.

Referring to the drawings in detail, FIG. 1 illustrates a side view of a reciprocating pump 10 for drilling fluid for use on a drilling or workover rig while FIG. 2 illustrates a perspective view of a frame 12 for the reciprocating pump apart from the other components of the pump 10. The reciprocating pump 10 may be mounted on a skid 14 so that it is self-contained and may be moved from location to location depending on the desired drilling site. For example, the skid 14 with the reciprocating pump may be loaded and moved on a flatbed truck.

The pump 10 includes a suction end 16 which may be connected to a drilling fluid tank (not shown) in order to supply drilling fluid. The pump 10 will also include a discharge end 18 so that drilling fluid is forced through the circulating fluid system.

The frame 12 of the pump 10 includes a well cavity or cavities. In the present embodiment, the frame includes three cavities 30, 32 and 34 wherein the piston rods and pistons operate. The cavities are each closed on five sides with an open top.

As seen in FIG. 1, a module block 52 is in fluid communication with the suction end 16 and the discharge end 18. Locking rings 58 and 60 are secured to the module block as will be described herein.

Figure 3:
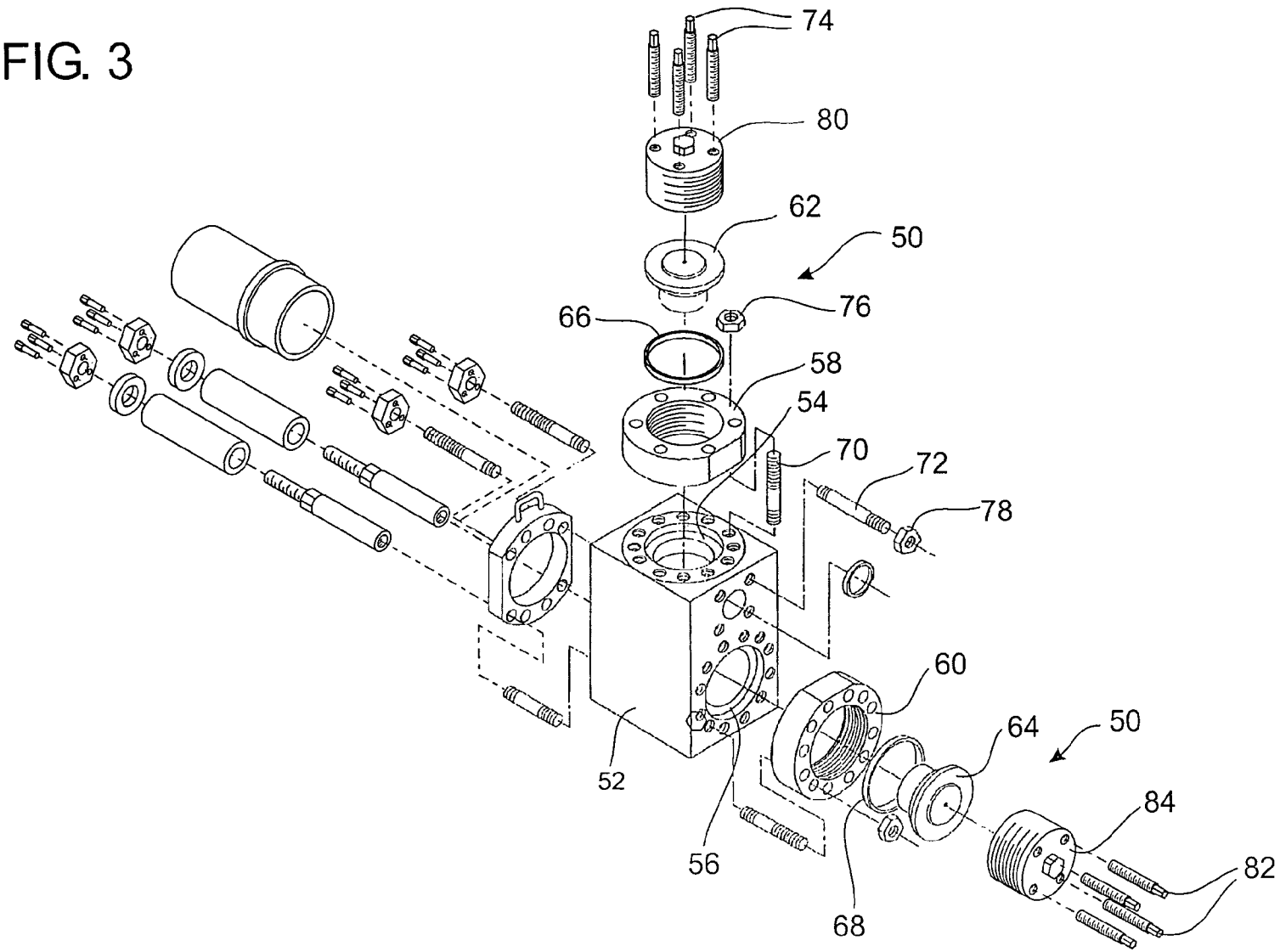
FIG. 3 is an exploded view of a known module block for the reciprocating pump of FIG. 1 with the valve cover locking screw assembly which is the subject of the present invention.
Figure 4:
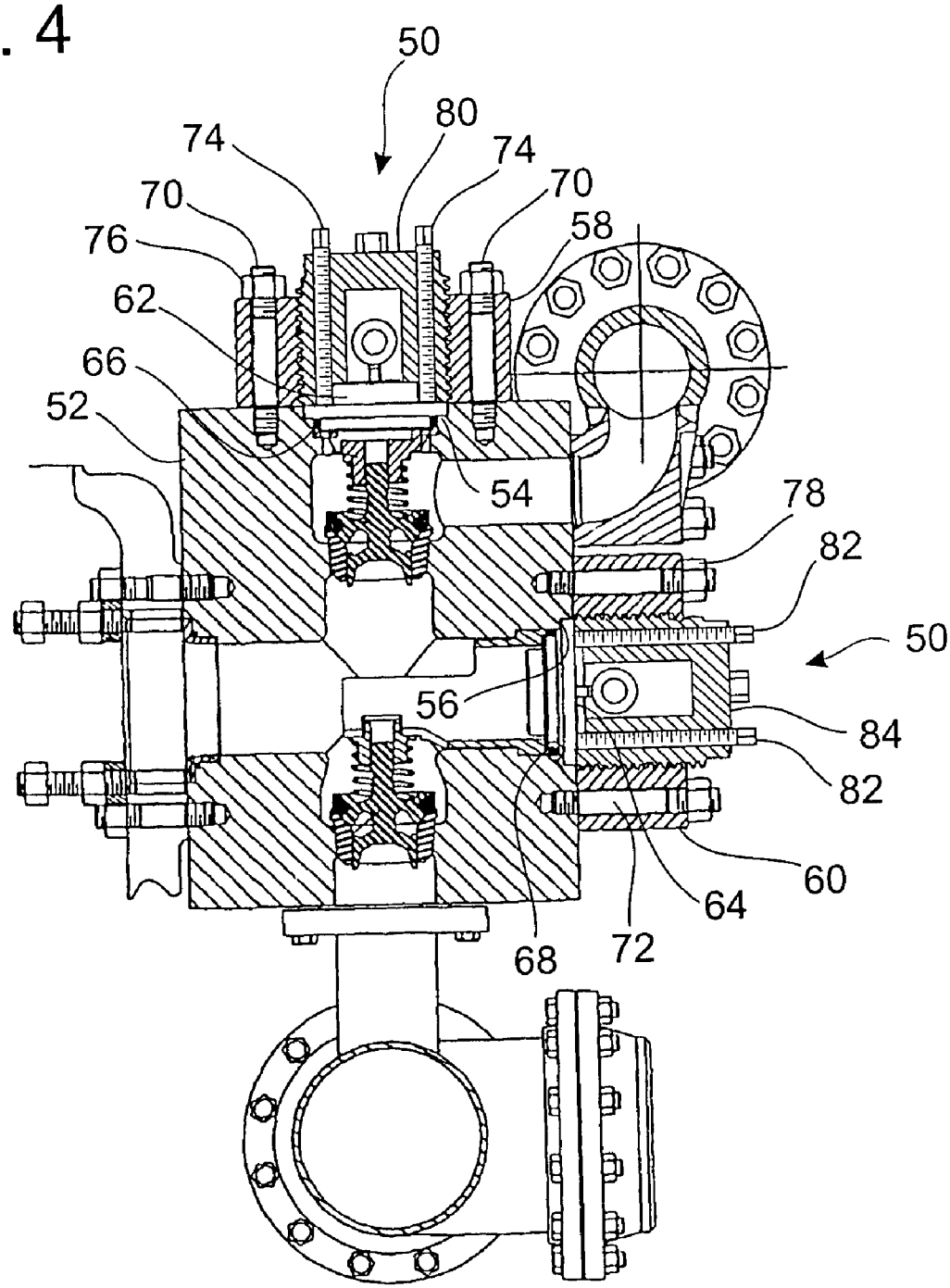
FIG. 4 is a sectional view of the module block and valve cover locking screw assembly shown in FIG. 3.

FIG. 3 is an exploded, perspective view of two separate assemblies of the valve cover locking screw assembly 50 of the present invention. A module block 52 will be in fluid communication with the suction end 16 and the discharge end 18 so that a piston forces fluid through the circulating fluid system.

The module block 52 has a number of recesses or bores such as bore 54 and bore 56. Each bore provides access to a valve or valves and associated components. A locking ring 58 surrounds the bore 54 and a locking ring 60 surrounds bore 56. Each locking ring 58 and 60 is cylindrical with internal threads.

The assembly 50 also includes valve covers 62 and 64, each valve cover having a diameter slightly less than the inside diameter of the ring.

A circular gasket 66 resides between valve cover 62 and module block 52. Likewise, a circular gasket 68 resides between valve cover 64 and module 52 to assist in forming a fluid tight seal.

A plurality of threaded studs, such as studs 70, and nuts 76 secures the locking ring 58 to the module block 52. Likewise, a plurality of threaded studs, such as stud 72 and nut 78, secures the locking ring 60 to the module block 52.

The assembly 50 also includes a valve cover locking screw 80 having cylindrical walls with external threads on the walls. The external threads mate with the internal threads on the locking ring 58. The locking screw 80 also includes a closed top and an open bottom.

Likewise, locking screw 84 has cylindrical walls with external threads on the cylindrical walls. The external threads mate with the internal threads on the locking ring 60. The locking screw 84 also includes a closed top and an open bottom.

A plurality of threaded bolts 74 engage a plurality of threaded openings through the cylindrical walls of the locking screw 80 so that the bolts force the valve cover against the module block to create a fluid tight seal. Each threaded opening is parallel to an axis of the cylindrical walls of the locking screw 80.

The process to install a valve cover will be described with respect to one bore and one valve cover. In order to utilize the valve cover locking system of the present invention, the removable valve cover 62 is inserted through the valve cover locking ring 58 which has been secured to the module block. Prior thereto, a circular gasket having a concentric opening is slipped over the end of the valve cover. Once inserted, the valve cover resides in a circular shoulder in the block. The locking ring 58 is located over the bore 54 of the module block 52. The locking ring is secured by studs 70 and nuts 76. The valve cover locking screw 80 with external threads is then threaded into the internal threads of the locking ring 58. The locking screw 80 may be rotated by rotating a head, such as a hex head, extending from the closed top. The external threads of the locking screw 80, thus, mate with the internal threads on the locking ring.

Thereafter, a plurality of bolts 74 are threaded through threaded openings through the cylindrical walls of the locking screw. The bolts 74 will pass through the locking screw 80 and force the valve cover against the module block.

Performing the operation in reverse order will allow removal of each valve cover and permit access to each bore.

Whereas, the present invention has been described in relation to the drawings attached hereto, it should be understood that other and further modifications, apart from those shown or suggested herein, may be made within the spirit and scope of this invention.

What is claimed is:

1. A valve cover locking screw assembly for a reciprocating pump module block having a bore, which assembly comprises:

a removable valve cover closing said bore, and a valve cover locking ring with internal threads surrounding said bore;

a valve cover locking screw having cylindrical walls with external threads, a closed top, and an open bottom;

a plurality of threaded bolts engaging a plurality of threaded openings through said closed top and through said cylindrical walls of said locking screw so that said plurality of bolts forces said valve cover against said module block to create a fluid tight seal; and a plurality of removable fasteners between said locking ring and said module block to secure said locking ring to said module block.

2. A valve cover locking screw assembly as set forth in claim 1 including a circular gasket between said valve cover and said module block to assist in forming a fluid tight seal.

3. A valve cover locking screw assembly as set forth in claim 1 wherein said bore in said module block includes a circular shoulder to receive said valve cover thereon.

4. A valve cover locking screw assembly as set forth in claim 1 including an eye bolt extending from said valve cover to act as a handle for said cover.

5. A valve cover locking screw assembly as set forth in claim 1 wherein each of said threaded bolts and each threaded opening is parallel to an axis of said cylindrical walls of said locking a screw.

6. A valve cover locking screw assembly as set forth in claim 1 including a head extending from said closed top of said locking screw.

7. A valve cover locking screw assembly as set forth in claim 1 wherein a diameter of said removable valve cover is slightly less than an inner diameter of said locking ring.

8. A valve cover locking screw assembly as set forth in claim 1 wherein said locking screw retrofits with an existing valve cover and locking ring.

9. A method to secure and seal a valve cover to a module block for a reciprocating pump, which method comprises:

inserting a removable valve cover through a valve cover locking ring secured to said module block over bore in said module block, wherein said valve cover locking ring is secured to said module block by removable fasteners;

threading a valve cover locking screw having cylindrical walls with external threads, a closed top, and an open bottom, in to said locking ring so that internal threads on said locking ring mate with said external threads of said locking screw; and threading a plurality of bolts through threaded openings in said closed top and through said cylindrical walls of said locking screw so that said bolts force said valve cover against said module block.

10. A method as set forth in claim 9 wherein said step of inserting said valve cover includes using an eye bolt extending front said cover as a handle.

11. A method as set forth in claim 9 including the additional step of inserting a circular gasket against said module before inserting said valve cover.

12. A method as set forth in claim 9 wherein said step of threading said valve cover is accomplished by rotating a head extending from said top of said locking screw.

13. A method as set forth in claim 9 wherein steps are performed in reverse order to remove said valve cover.

* * * * *